US005668564A

United States Patent [19]

Seward et al.

[11] Patent Number: 5,668,564

[45] Date of Patent: Sep. 16, 1997

[54] COMBINED AM/FM/CELLULAR TELEPHONE ANTENNA SYSTEM

[75] Inventors: Glen J. Seward, Cincinnati, Ohio; Robert M. Lynas; Paul E. Miller, both of Spring Lake, Mich.; Robert B. Ennenga, Grand Haven, Mich.

[73] Assignee: R.A. Miller Industries, Inc., Grand Haven, Mich.

[21] Appl. No.: 603,176

[22] Filed: Feb. 20, 1996

[51] Int. Cl.[6] ..... H01Q 9/16; H01Q 1/32

[52] U.S. Cl. ..... 343/791; 343/790; 343/792; 343/715

[58] Field of Search ..... 343/791, 790, 343/792, 715, 749, 906, 751, 722, 727, 729, 730; H01Q 9/04, 9/16, 1/32

[56] References Cited

U.S. PATENT DOCUMENTS

| | | | |
|---|---|---|---|
| 3,725,942 | 4/1973 | Ukmar | 343/715 |
| 3,981,017 | 9/1976 | Kommrusch | 343/792 |
| 4,085,405 | 4/1978 | Barlow | 343/850 |
| 4,117,493 | 9/1978 | Altmayer | 343/715 |
| 4,222,053 | 9/1980 | Newcomb | 343/722 |
| 4,229,743 | 10/1980 | Vo et al. | 343/749 |
| 4,375,642 | 3/1983 | Dörrie et al. | 343/895 |
| 4,404,564 | 9/1983 | Wilson | 343/750 |
| 4,509,056 | 4/1985 | Ploussios | 343/791 |
| 4,647,941 | 3/1987 | Myer | 343/792 |
| 4,658,260 | 4/1987 | Myer | 343/792 |
| 4,675,687 | 6/1987 | Elliott | 343/715 |
| 4,721,965 | 1/1988 | Elliott | 343/715 |
| 4,748,450 | 5/1988 | Hines et al. | 343/791 |
| 4,825,217 | 4/1989 | Choi | 343/715 |
| 4,940,989 | 7/1990 | Austin | 343/749 |
| 5,079,562 | 1/1992 | Yarsunas et al. | 343/792 |
| 5,089,829 | 2/1992 | Haruyama et al. | 343/852 |
| 5,248,988 | 9/1993 | Makino | 343/792 |

OTHER PUBLICATIONS

H. Jasik, Antenna Engineering Handbook, McGraw–Hill, 1961, Chapter 22, pp. 22–1 through 2–20.

Hall et al, The ARRL Antenna Book, The American Radio Relay League, Inc., 1983, pp. 5–17 through 5–22.

*Primary Examiner*—Hoanganh T. Le

*Attorney, Agent, or Firm*—Varnum, Riddering, Schmidt & Howlett LLP

[57] ABSTRACT

A combined AM/FM/cellular telephone antenna system comprises a coaxial cable with an upper portion of the inner conductor of the coaxial cable and an adjacent section of the coaxial cable together forming a cellular telephone dipole antenna. The coaxial cable forms a transmission line connecting the cellular dipole antenna to cellular telephone equipment. The outer conductor of a portion of the coaxial cable below the cellular dipole antenna serves as the AM/FM antenna. The combined antenna is encaged in a fiberglass housing and mounted on a metallic base having an upper shell and a lower shell. The upper shell is electrically connected to the outer conductor of the coaxial cable forming the antenna and the lower shell is connected to a ground plane. A coaxial cable having a center conductor connected to the upper shell and an outer conductor connected to the lower shield provides connection to AM/FM receiver equipment. Another coaxial cable having a center conductor connected to the center conductor of the antenna and an outer conductor connected to the lower shell provides connection to cellular telephone apparatus. A dielectric between the upper and lower shells provides a capacitance with low impedance in the cellular telephone frequency range and a high impedance in the AM/FM frequency range.

15 Claims, 3 Drawing Sheets

COMBINED AM/FM/CELLULAR TELEPHONE ANTENNA SYSTEM

BACKGROUND OF THE INVENTION

1. Field of the Invention

This invention relates to motor vehicle antennas and more particularly to a multiband AM/FM/cellular telephone antenna system suitable for use on automotive vehicles.

2. Description of the Related Art

In recent years with the introduction of cellular telephone systems, the use of telephones in motor vehicles has increased dramatically. The cellular telephone system typically requires a separate antenna. On automobiles, the cellular antenna may be factory-installed original equipment or subsequently installed after-market equipment. The cellular telephone antenna is typically a rear window mounted antenna or a trunk lid antenna. The window mounted antenna is preferred since it may be mounted at a higher location than the trunk lid. The window mounted antenna extends above the roof of the passenger compartment to gain height, thereby extending operating range and to avoid the blocking of signals by the passenger compartment.

Particularly for after-market equipment, the installation of the necessary wiring from the front of the car to the rear window mounted antenna, preferably hidden from view behind the roof headliner, is a time-consuming job which adds substantially to the cost of installation of the cellular telephone in the vehicle.

Since practically all cars, trucks and the like are equipped with an AM/FM radio, more and more such vehicles now have two antennas, one for the AM/FM radio and another for the cellular telephone. The AM/FM antenna is almost always a rod antenna. The cellular telephone antenna typically includes a helically wound coil near the middle of the antenna. The coil improves the effectiveness of the antenna by impeding phase reversal, but detracts from the overall appearance. Furthermore, a well-known problem with the cellular telephone antenna of that type is the wind noise or whistle caused by the coil when the vehicle travels at highway speeds.

Cellular phone antennas are typically rod antennas and mounted on or adjacent a ground plane area, such a trunk lid or passenger compartment roof, since a substantial ground plane is necessary for effectiveness of the typical rod antenna. Cellular phone rod antennas are generally not mounted on vehicle fenders, as are AM/FM antennas, since the fender typically drops off nearly vertically and does not always provide the desired ground plane at cellular phone frequencies.

Portable vehicular cellular telephones offer flexibility in that they may be taken from vehicle to vehicle. A serious drawback of these portable cellular phones is that their range is limited. This is due in large part to the limitations of the antenna of the portable units. The portable vehicular cellular telephones are typically provided with an inefficient, flexible whip antenna referred to as a "rubber ducky." When they are used with such an antenna in cars or trucks and the like, the range of these units and their usefulness is limited due to the ineffective antenna and due to signal blocking by the metallic vehicle enclosure.

SUMMARY OF INVENTION

These and other problems associated with the use of cellular telephones in automotive vehicles are solved in accordance with the principles of this invention by a combined AM/FM/cellular telephone antenna system which employs a single antenna structure incorporating two antennas without degrading the performance of either.

An antenna in accordance with the present invention is formed from a coaxial cable, preferably enclosed in a fiberglass casing, with an upper part of the inner conductor of the coaxial cable together with a portion of the outer shield forming a cellular telephone dipole antenna and the outer shield forming the equivalent of an AM/FM rod antenna. The coaxial cable antenna structure is mounted on an antenna base comprising an upper conductive shell and a lower conductive shell insulated from the upper conductive shell by a dielectric. The outer conductive shield forming the AM/FM antenna is connected to the upper shell and the inner conductor is connected to a base conductor insulated from the upper shell and the lower shell.

The antenna of the invention is preferably mounted on a metallic fender or cowl of an automobile or the like with the lower shell of the base electrically connected to the fender to form a part of a ground plane. A dielectric between the upper and lower conductive shells serves to provide a capacitance between the upper and lower shells to provide a low impedance to cellular telephone frequency signals and a high impedance for AM/FM signals.

In accordance with one particular aspect of the invention, the outer conductive shield and upper conductive shell form an AM/FM antenna having an electrical length equal to one-quarter wavelength of a signal in the FM frequency range, and the upper portion of the center conductor above an antenna feed point together with a portion of the outer conductive shield extending below the feed point, each having an electrical length equal one-quarter wavelength in the cellular telephone frequency range, form a cellular telephone antenna.

Advantageously, the cellular antenna section is disposed at the upper part of the antenna structure, typically, above the level of the roof of passenger compartment, aiding the effectiveness of the antenna. Furthermore, the cellular telephone antenna of the present invention is a dipole antenna, which is not substantially affected by the shape or contour of the area on which it is mounted and advantageously may be mounted on a fender or other area, or on fiberglass which does not provide a proper ground plane, without loss of effectiveness. In accordance with one aspect of the invention, a coaxial connector is incorporated in the dashboard of the automobile which allows a portable telephone system to be connected to the more efficient combined AM/FM/cellular telephone antenna, thereby significantly enhancing the usefulness of the portable units in automobiles. The portable telephone may be connected to the vehicle battery via a connector in the dashboard.

Advantageously, Applicants' combined AM/FM/cellular telephone antenna provides a better match to vehicular cellular phone systems than many prior art antennas and provides improvements in gain over standard magnetic mount and glass mount cellular telephone antennas. Furthermore, with the antenna of the present invention, operation of the cellular phone does not create any discernable interference in AM/FM reception.

BRIEF DESCRIPTION OF THE DRAWINGS

A preferred embodiment of the invention is described below with reference to the drawing in which.

DETAILED DESCRIPTION

Figure 1:
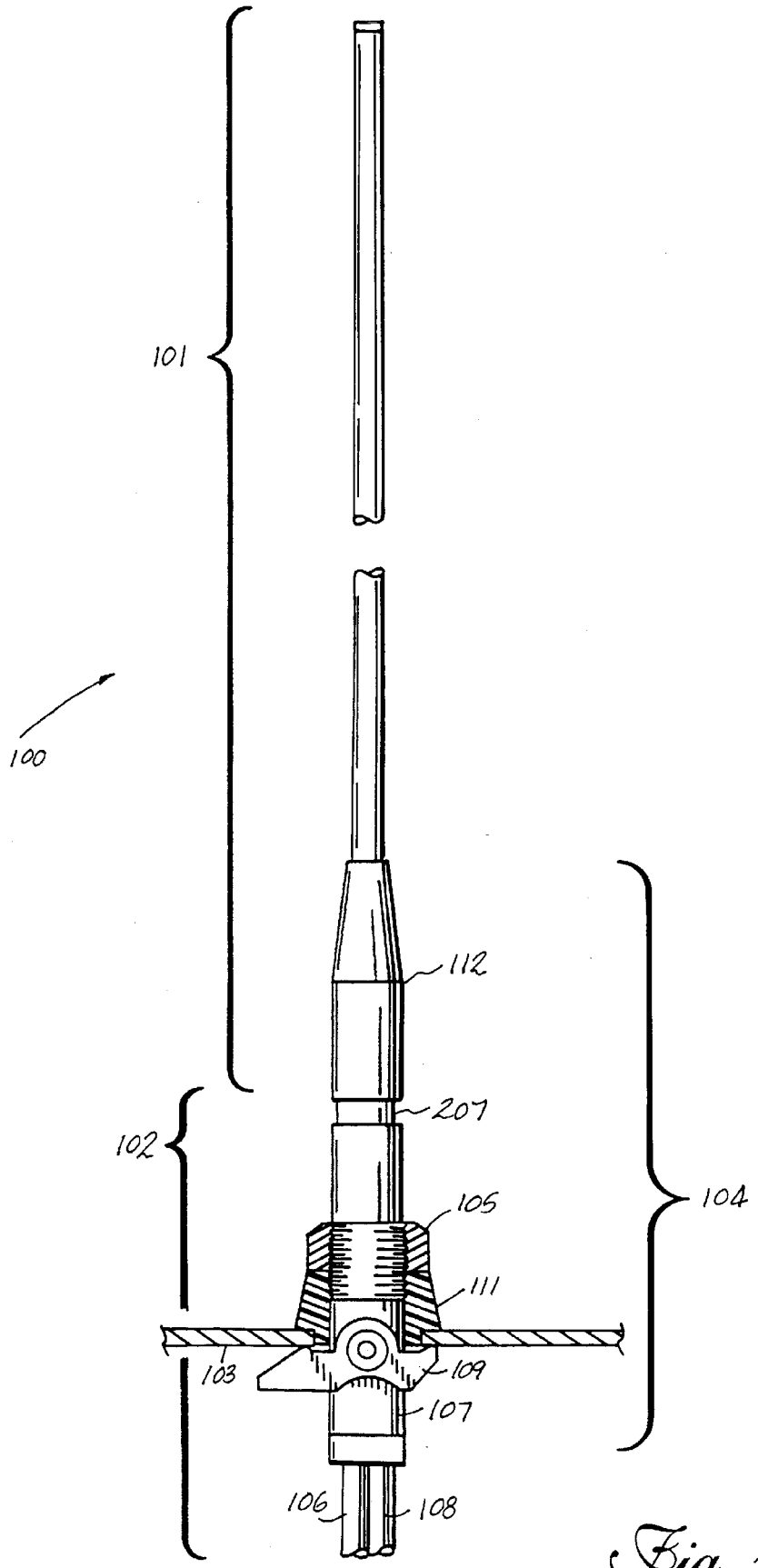
FIG. 1 is an elevational view of an antenna structure incoporating principles of the invention.

FIG. 1 is an elevational view of an antenna structure 100 in accordance with the invention and comprising a whip antenna section 101, a base section 102 and a connector section 104. The connector section 104 comprises an upper shell 112 electrically insulated from a lower shell 107 by an insulating sleeve 207. The antenna may be conveniently mounted on a vehicle fender or other support structure by means of the lower shell 107, provided with pivotal ears 109 engaging a lower surface of fender 103, and a mounting nut 105 spaced apart from the fender 103 by means of a sealing grommet 111. A pair of coaxial cables 106, 108 connect to the antenna to receiver/transmitter apparatus (not shown in the drawing).

Figure 2:
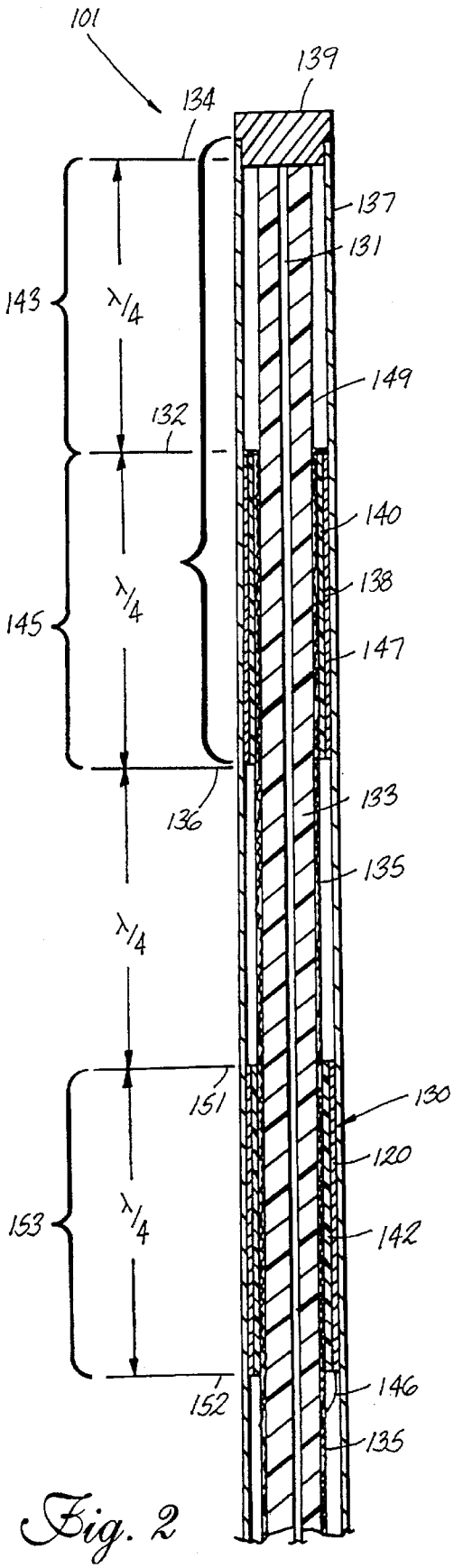
FIG. 2 is a cross sectional view of an upper portion of the whip section of the antenna structure of FIG 1.

FIG. 2 is a cross sectional view of an upper portion of the whip section 101 of the antenna structure 100. FIG. 2 shows a portion of a coaxial cable 130 comprising a center conductor 131, a dielectric 133 and a braided wire outer conductor 135. The coaxial cable 130 is encased within a fiberglass housing 137 which is closed at its upper end by means of a fiberglass cap 139. An upper section of the antenna structure forms a dipole antenna 141 at the cellular telephone frequency of approximately 860 megahertz (MHz). One-half of the dipole antenna is formed by the portion of the center conductor 131 extending between a feed point 132 and its upper end 134. The other half of the dipole antenna is formed by a conductive sleeve 138. A dielectric layer 140 extends between outer conductor 135 and sleeve 138. The conductive sleeve 138 and dielectric layer 140 extend from a terminating point 136 up to feed point 132 where the sleeve 138 is electrically connected to the outer conductor 135. The upper section 143 of dipole antenna 141, extending between the feed point 132 and the end point 134, and the lower section 145, extending between the feed point 132 and terminating point 136, each form one-half of the dipole antenna. Each section 143,145 has an electrical length equivalent to one-quarter wavelength at a selected mid-range frequency, e.g. approximately 860 MHz, in the cellular frequency range. The portion of the center conductor extending below the feed point 132 serves as a transmission line for signals in the cellular frequency range, connecting the cellular dipole antenna 141 to the connector section 104 (FIG. 1).

Disposed a distance, equivalent to one-quarter wavelength at the cellular mid-range frequency, below the dipole antenna 141 is a quarter wavelength cellular frequency trap 153. The trap 153 comprises a conductive sleeve 120 having an electrical length equivalent to one-quarter wavelength in the cellular frequency range and extending between an upper end 151 and a lower end 152 of the trap 153. The sleeve 120 is insulated from the outer conductor 135 over the length of the sleeve by a dielectric 142. A conductive strap 146 provides electrical connection between the outer conductor 135 and the sleeve 120. The trap 153 serves to reduce cellular frequency currents in the lower part of the outer conductor 135.

The thickness dimensions of the sleeves 138 and 120 and of the dielectric layers 140 and 142 may be adjusted as desired. For aesthetic purposes and to minimize wind drag on the antenna, it is desirable to keep these dimensions to a minimum. However, to obtain the proper electrical characteristics for the lower portion 145 of the dipole 141 and for the trap 153 certain minimum thicknesses must be maintained. As an alternative implementation of the lower portion 145 of the dipole 141, a portion of the outer conductor 135 may be folded back to take the place of the sleeve.

Figure 3:
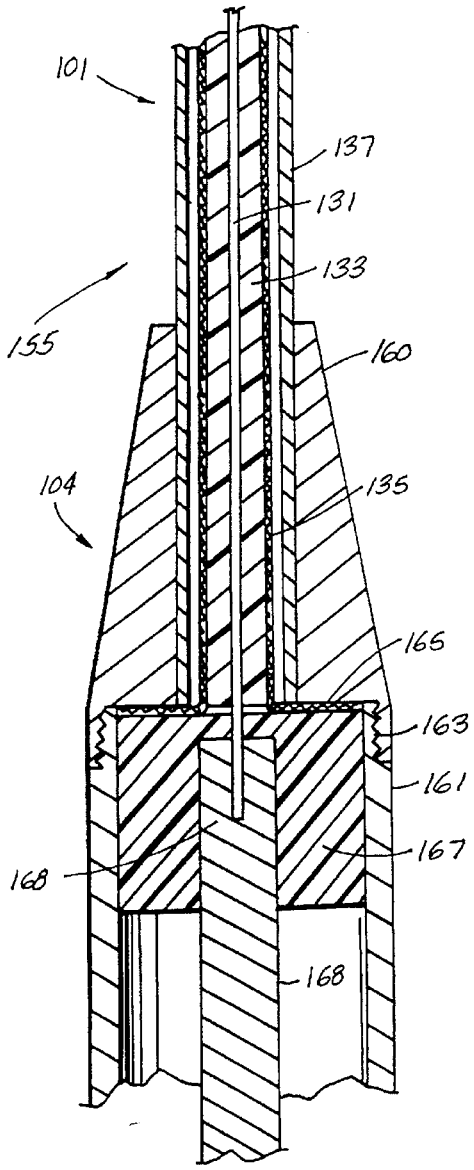
FIG. 3 is a cross sectional view of a lower portion of the whip section and an upper portion of a connector section shown in FIG. 1.

The outer conductor 135 over its entire length, up to the feed point 132, forms the radiating element of the AM/FM portion of the antenna. An upper portion of the AM/FM antenna section 155 is shown in FIG. 2 and a lower portion of the AM/FM antenna section 155 is shown in FIG. 3. Further shown in FIG. 3, also in cross section, is an upper portion of the connector section 104. The connector section 104 comprises an upper attachment nut 160, engaging a housing 161 by means of a threaded section 163 or other suitable attachment means. The dielectric portion 133 of the coaxial cable 130 terminates at a lower wall 165 of the attachment nut 160 while the center conductor 131 extends through an opening in the lower wall 165 of the nut 160 through an insulator spacer 167 into a longitudinally extending conductor rod 168 formed of copper or other suitable conductive material. The outer conductor 135 extends along the lower wall 165 of the nut 160 to provide low impedance electrical contact between the outer conductor 135, which serves as the AM/FM antenna radiating element, and the housing 161.

Figure 4:
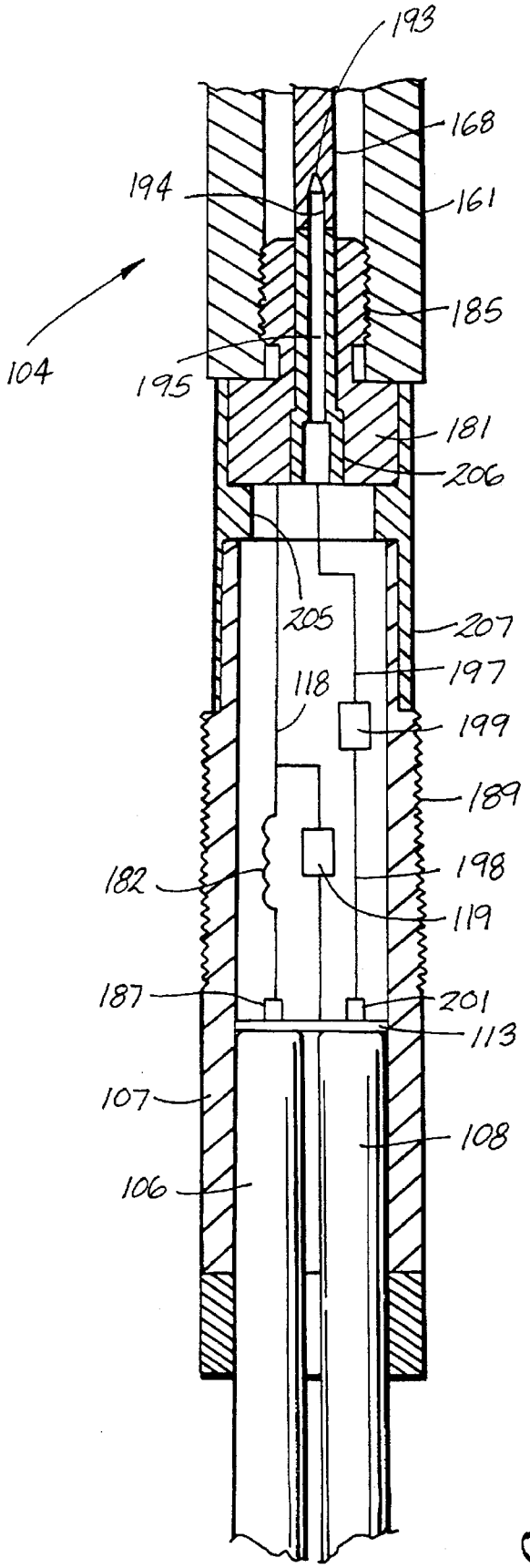
FIG. 4 is a cross sectional view of a lower portion of the connector section.

FIG. 4 shows a lower portion of the base connector 104, including a lower section of the housing 161 of FIG. 3. The housing 161 engages a metallic conductor section 181 by means of threads, as shown at 185. The center conductor 187 of coaxial cable 106, extending from an AM/FM receiver (not shown in the drawing), is electrically connected to conductor section 181 via a series inductor 182 and lead 118. The inductor 182 is selected to have a value of inductance so as to provide a high impedance at 830 MHz to further isolate the AM/FM radio from cellular frequency signals. In this manner, the center conductor 187 of the AM/FM coaxial cable 106 is electrically connected via upper shell 112 to the outer conductor 135 of the antenna which forms the AM/FM signal receiving portion.

The coaxial cable 106 is provided with an outer conductor 190 which is electrically connected at 113 to the lower shell 107. The lower shell 107 is provided with a threaded section 189 for engagement with the mounting nut 105 shown in FIG. 1. For the sake of simplicity, the ears 109 which are mounted to the lower shell 107, as shown in FIG. 1, are not shown in FIG. 4. The lower shell 107 is connected to the vehicle ground through the ears 109. The lead 118 is further connected to the lower shell, and hence to system ground, at 113 via capacitor 119. Capacitor 119 provides a low impedance to cellular frequency signals and a high impedance to AM/FM frequency signals and serves to further isolate the AM/FM receiver from cellular frequency signals.

As shown in FIG. 4, a lower end of conductor rod 168 is in electrical contact with a conductor section 195 provided with an end connector 193 which engages rod 168 in slot 194. The slot 194 may be provided with a well-known fingered female contact or like to assure proper electrical connection. The conductor section 195 is electrically insulated from conductor section 181 by insulator section 206 and electrically connected via leads 197, 198 and a capacitor 199, to the center conductor 201 of coaxial cable 108. The coaxial cable 108 connects to cellular telephone equipment (not shown in the drawing). A braided outer shield of the cable 108 is connected to the lower shell 107 and hence to system ground at 113. In this manner, cellular telephone equipment is connected to the center conductor of the cellular telephone dipole antenna section 141 via conductor rod 168 (FIGS. 3 and 4), the conductor section 195, the leads 197, 198, the capacitor 199 and the center conductor 201 of coaxial cable 108. The capacitor 199 is preferably a five-picofarad capacitor which will be series resonant at approximately 850 MHz when connected in series with wire conductors having an overall length of approximately 0.35 inches.

The conductor section 181 is in electrical contact with the housing section 161. The conductor section 195, connected to the center conductor 198 of cellular telephone coaxial cable 108, is insulated from the conductor section 181 by an appropriate insulator 206. The upper housing section 161 of upper shell 112 is spaced apart and insulated from the lower shell 107 by means of an insulator sleeve 207, including an annular insulator ring 205, to form a capacitor. The sleeve 207 consists of a material having good dielectric properties at 860 MHz, i.e., the approximate center of the cellular frequency range. Capacitance between the upper shell 112 and the lower shell 107 is preferably maintained at a value of approximately ten picofarads by controlling the spacing between the upper and lower shells or adding a fixed capacitor between the two. This capacitance offers a relatively low impedance at cellular phone frequencies and provides additional base capacitance for the AM/FM antenna.

It will be understood that the above-described arrangement is an illustrative embodiment of the invention and that other arrangements may be devised by those skilled in the art without departing from the scope of the invention as defined by the appended claims.

What we claim is:

1. A combined AM/FM/cellular telephone antenna system comprising:

a longitudinally extending coaxial cable comprising a center conductor and an outer conductor and having an upper end and a lower end;

an antenna connector attached to the lower end of the coaxial cable and having an upper conductive shell electrically connected to the outer conductor and a lower conductive shell electrically insulated from the upper conductive shell and an inner conductive section electrically connected to the center conductor;

an upper portion of the coaxial cable forming a cellular telephone dipole antenna section adjacent the upper end of the coaxial cable and comprising a portion of the center conductor extending above a dipole antenna feed point and an outer conductive sleeve extending over a portion of the outer conductor extending below the dipole antenna feed point and electrically connected to the outer conductor adjacent the feed point;

the outer conductor forming an AM/FM antenna section comprising a lower portion of the outer conductor below the dipole antenna feed point.

2. The antenna system in accordance with claim 1 wherein the lower portion of the outer conductor has an electrical length equal to one quarter wavelength of a signal in the FM frequency range.

3. The antenna in accordance with claim 2 wherein the portion of the center conductor and the portion of the outer conductor each have an electrical length equivalent to one-quarter wavelength of a signal in the cellular telephone frequency range.

4. The antenna in accordance with claim 3 and further comprising a layer of dielectric disposed between the outer conductor and the outer conductive sleeve.

5. The antenna system in accordance with claim 1 and further comprising an additional conductive sleeve extending over a portion of the outer conductor extending below the cellular dipole antenna, the additional conductive sleeve having a lower end electrically connected to outer conductor.

6. The antenna system in accordance with claim 5 wherein the additional conductive sleeve has an electrical length equivalent to one quarter wavelength of a signal in the cellular telephone frequency range and the conductive sleeve has an upper end disposed below a lower end of the cellular dipole antenna by a distance equivalent to the electrical length of one quarter wavelength of a signal in the cellular telephone frequency range.

7. The antenna system in accordance with claim 1 and further comprising a first coaxial conductor for connection to an AM/FM receiver and a second coaxial conductor for connection to cellular telephone apparatus;

the first and second coaxial conductors each comprising a center conductor and an outer conductor, the outer conductor of each of the first and second coaxial conductors connected to the lower shell and the center conductor of the first coaxial conductor connected the upper shell and the center conductor of the second coaxial conductor connected to the center conductor of the antenna connector.

8. The apparatus in accordance with claim 7 and further comprising a capacitor connected between the center conductor of the antenna connector and the center conductor of the second coaxial conductor and an inductor connected between the upper shell and the center conductor of the first coaxial conductor.

9. The apparatus in accordance with claim 8 wherein the capacitor has a capacitance of 5 picofarads.

10. The apparatus in accordance with claim 7 and further comprising an inductor connected between the center conductor of the first coaxial conductor and the upper shell and having high impedance at cellular frequencies.

11. The apparatus in accordance with claim 7 and further comprising an interconnecting conductor connected in series with a capacitor and connected between the center conductor of the antenna connector and the center conductor of the second coaxial conductor and the capacitor and the interconnecting conductor together forming a series resonant circuit for signals in the cellular frequency range.

12. The apparatus in accordance with claim 1 and further comprising a dielectric material disposed between the upper shell and the lower shell forming a capacitor with the upper shell and the lower shell and wherein the lower shell is electrically connected to a ground plane and the capacitor presents a low impedance path for signals in the cellular frequency range.

13. A combined AM/FM/cellular telephone antenna system comprising:

a longitudinally extending coaxial cable comprising a center conductor and an outer conductor and having an upper end and a lower end;

an upper portion of the coaxial cable adjacent the upper end forming a cellular telephone dipole antenna section comprising a portion of the center conductor extending above a dipole antenna feed point and an outer conductive sleeve extending over a portion of the outer conductor extending below the dipole antenna feed point and electrically connected to the outer conductor adjacent the feed point;

the outer conductor forming an AM/FM antenna section comprising a lower portion of the outer conductor below the dipole antenna feed point;

an antenna connector attached to the lower end of the coaxial cable and having an upper conductive shell electrically connected to the outer conductor and a lower conductive shell forming a ground plane connection and an insulator sleeve disposed between the upper conductive shell and the lower conductive shell electrically insulating the lower conductive shell from the upper conductive shell and an inner conductive section electrically insulated from the upper and lower conductive shells and electrically connected to the center conductor.

14. The antenna system in accordance with claim 13 wherein the upper conductive shell comprises a central opening and the lower conductive section extends at least partially into the central opening.

15. The antenna system in accordance with claim 14 wherein the lower conductive shell is electrically connected to a ground plane and wherein the upper conductive shell and lower conductive shell together form a capacitor presenting a low impedance path for signals in the cellular frequency range.

* * * * *